US009439005B2

(12) United States Patent
Jensen

(10) Patent No.: US 9,439,005 B2
(45) Date of Patent: Sep. 6, 2016

(54) SPATIAL FILTER BANK FOR HEARING SYSTEM

(71) Applicant: Oticon A/S, Smørum (DK)

(72) Inventor: Jesper Jensen, Smørum (DK)

(73) Assignee: OTICON A/S, Smorum (DK)

( * ) Notice: Subject to any disclaimer, the term of this patent is extended or adjusted under 35 U.S.C. 154(b) by 0 days.

(21) Appl. No.: 14/551,171

(22) Filed: Nov. 24, 2014

(65) Prior Publication Data

US 2015/0156592 A1 Jun. 4, 2015

(30) Foreign Application Priority Data

Nov. 25, 2013 (EP) ..... 13194269

(51) Int. Cl.
*H04R 25/00* (2006.01)
*H04R 1/10* (2006.01)

(52) U.S. Cl.
CPC ..... *H04R 25/552* (2013.01); *H04R 25/407* (2013.01); *H04R 25/50* (2013.01); *H04R 1/1083* (2013.01); *H04R 25/43* (2013.01); *H04R 25/453* (2013.01); *H04R 25/554* (2013.01)

(58) Field of Classification Search
None
See application file for complete search history.

(56) References Cited

U.S. PATENT DOCUMENTS

| | | | | |
|---|---|---|---|---|
| 6,987,856 | B1 | 1/2006 | Feng et al. | |
| 8,526,647 | B2 * | 9/2013 | Pedersen | H04R 25/407 381/313 |
| 2003/0063759 | A1 * | 4/2003 | Brennan | H04R 3/005 381/92 |
| 2012/0093336 | A1 | 4/2012 | Said et al. | |

FOREIGN PATENT DOCUMENTS

| | | |
|---|---|---|
| EP | 1 962 547 A1 | 8/2008 |
| WO | WO 03/015464 A2 | 2/2003 |

* cited by examiner

*Primary Examiner* — Brenda Bernardi
(74) *Attorney, Agent, or Firm* — Birch, Stewart, Kolasch & Birch, LLP

(57) ABSTRACT

The present invention regards a hearing system configured to be worn by a user comprising an environment sound input unit, an output transducer, and electric circuitry. The environment sound input unit is configured to receive sound from the environment of the environment sound input unit and to generate sound signals representing sound of the environment. The output transducer is configured to stimulate hearing of a user. The electric circuitry comprises a spatial filterbank. The spatial filterbank is configured to use the sound signals to generate spatial sound signals dividing a total space of the environment sound in subspaces. Each spatial sound signal represents sound coming from a subspace. The subspaces may (in particular modes of operation) be either fixed, or dynamically determined, or a mixture thereof.

17 Claims, 4 Drawing Sheets

SPATIAL FILTER BANK FOR HEARING SYSTEM

The invention regards a hearing system configured to be worn by a user comprising, an environment sound input unit, an output transducer, and electric circuitry, which comprises a spatial filterbank configured to divide sound signals in subspaces of a total space.

Hearing systems, e.g., hearing devices, binaural hearing aids, hearing aids or the like are used to stimulate the hearing of a user, e.g., by sound generated by a speaker or by bone conducted vibrations generated by a vibrator attached to the skull, or by electric stimuli propagated to electrodes of a cochlear implant. Hearing systems typically comprise a microphone, an output transducer, electric circuitry, and a power source. The microphone receives a sound and generates a sound signal. The sound signal is processed by the electric circuitry and a processed sound (or vibration or electric stimuli) is generated by the output transducer to stimulate the hearing of the user. In order to improve the hearing experience of a user, a spectral filterbank can be included in the electric circuitry, which, e.g., analyses different frequency bands or processes sound signals in different frequency bands individually and allows improving the signal-to-noise ratio. Spectral filterbanks are typically running online in many hearing aids today.

Typically, the microphones of the hearing system used to receive the incoming sound are omnidirectional, meaning that they do not differentiate between the directions of the sound. In order to improve the hearing of a user, a beamformer can be included in the electric circuitry. The beamformer improves the spatial hearing by suppressing sound from other directions than a direction defined by beamformer parameters. In this way the signal-to-noise ratio can be increased, as mainly sound from a sound source, e.g., in front of the user, is received. Typically, a beamformer divides the space in two subspaces, one from which sound is received and the rest, where sound is suppressed, which results in spatial hearing.

US 2003/0063759 A1 presents a directional signal processing system for beamforming information signals. The directional signal processing system includes a plurality of microphones, a synthesis filterbank, a signal processor, and an oversampled filterbank with an analysis filterbank. The analysis filterbank is configured to transform a plurality of information signals in time domain from the microphones into a plurality of channel signals in transform domain. The signal processor is configured to process the outputs of the analysis filter bank for beamforming the information signals. The synthesis filterbank is configured to transform the outputs of the signal processor to a single information signal in time domain.

U.S. Pat. No. 6,925,189 B1 shows a device that adaptively produces an output beam including a plurality of microphones and a processor. The microphones receive sound energy from an external environment and produce a plurality of microphone outputs. The processor produces a plurality of first order beams based on the microphone outputs and determines an amount of reverberation in the external environment, e.g., by comparison of the first order beams. The first order beams can have a sensitivity in a given direction different from the other channels. The processor further adaptively produces a second order output beam taking into consideration the determined amount of reverberation, e.g., by adaptively combining the plurality of first order beams or by adaptively combining the microphone outputs.

In EP 2 568 719 A1 a wearable sound amplification apparatus for the hearing impaired is presented. The wearable sound amplification apparatus comprises a first ear piece, a second ear piece, a first sound collector, a second sound collector, and a sound processing apparatus. Each of the first and second sound collectors is adapted for collecting sound ambient to a user and for outputting the collected ambient sound for processing by the sound processing apparatus. The sound processing apparatus comprises sound processing means for receiving and processing diversity sounds collected by the first and second sound collector using diversity techniques such as beamforming techniques. The sound processing apparatus further comprises means for subsequently outputting audio output to the user by or through one of or both the first and second ear pieces. The sound collectors are adapted to follow head movements of the user when the head of the user turns with respect to the body of the user.

It is an object of the invention to provide an improved hearing system.

This object is achieved by a hearing system configured to be worn by a user, which comprises an environment sound input unit, an output transducer, and electric circuitry. The environment sound input unit is configured to receive sound from the environment of the environment sound input unit and to generate sound signals representing sound of the environment. The output transducer is configured to stimulate hearing of a user. The electric circuitry comprises a spatial filterbank. The spatial filterbank is configured to use the sound signals to generate spatial sound signals dividing a total space of the environment sound in subspaces, defining a configuration of subspaces. Each spatial sound signal represents sound coming from a respective subspace. The environment sound input unit can for example comprise two microphones on a hearing device, a combination of one microphone on each of a hearing device in a binaural hearing system, a microphone array and/or any other sound input that is configured to receive sound from the environment and which is configured to generate sound signals from the sound which represent sound of the environment including spatial information of the sound. The spatial information can be derived from the sound signals by methods known in the art, e.g., determining cross correlation functions of the sound signals. Space here means the complete environment, i.e., surrounding of a user. A subspace is a part of the space and can for example be a volume, e.g. an angular slice of space surrounding the user (cf. e.g. FIGS. 2A-2E). The subspaces may but need not be of equal form and size, but can in principle be of any form and size (and location relative to the user). Likewise, the subspaces need not add up to fill the total space, but may be focused on continuous or discrete volumes of the total space around a user.

A specific 'configuration of subspaces' is in the present context taken to mean a specific 'geometrical arrangement of subspaces', as e.g. defined by one or more subspace parameters, which may include one or more of: a specific number of subspaces, a specific size (e.g. of a cross-sectional area or a volume) of the individual subspaces, a specific form (e.g. a spherical cone, or a cylindrical slice, etc.) of the individual subspaces, a location of the individual subspaces, a direction from the user (wearing the hearing system) to a point in space separated from the user defining an elongate volume (e.g. a cone). It is intended that a specific configuration of subspaces is defined by one of more subspace parameters as mentioned above or elsewhere in the present disclosure.

The spatial filterbank can also be configured to divide the sound signals in subspaces of the total space generating spatial sound signals. Alternatively, the electric circuitry can also be configured to generate a total space sound signal from the sound signals and the spatial filterbank can be configured to divide the total space sound signal in subspaces of the total space generating spatial sound signals.

One aspect of the invention is an improved voice signal detection and/or target signal detection, by performing a target signal detection and/or a voice activity detection on a respective spatial sound signal. Assuming that the target signal is present in a given subspace, the spatial sound signal of that subspace may have an improved target signal-to-noise signal ratio compared to sound signals which include the total space (i.e. the complete surrounding of a user), or other subspaces (not including the sound source in question). Further, the detection of several sound sources, e.g., talkers in different subspaces is possible by running voice activity detection in parallel in the different subspaces. Another aspect of the invention is that the location and/or direction of a sound source can be estimated. This allows to select subspaces and perform different processing steps on different subspaces, e.g., different processing of subspaces comprising mainly voice signals and subspaces comprising mainly noise signals. For example dedicated noise reduction systems can be applied to enhance the sound signals from the direction or directions of the sound source. Another aspect of the invention is that the hearing of a user can be stimulated by a spatial sound signal representing a certain subspace, e.g., a subspace behind the user, in front of the user, or at the side of a user, e.g., in a car-cabin situation. The spatial sound signal can be selected from the plurality of spatial sound signals, allowing to almost instantly switch from one subspace to another subspace, preventing the possible missing of the beginning of a sentence in a conversation, when the user first has to turn into the direction of the sound source or focus on the subspace of the sound source. A further aspect of the invention is an improved feedback howl detection. The invention allows an improved distinction between the following two situations: i) a feedback howl and ii) an external signal, e.g., a violin playing, which generates a similar sound signal as a feedback howl. The spatial filterbank allows to exploit the fact that feedback howls tend to occur from a particular subspace or direction, so that the spatial difference between a howl and the violin playing can be exploited for improved howl detection.

The hearing system is preferably a hearing aid configured to stimulate the hearing of a hearing impaired user. The hearing system can also be a binaural hearing system comprising two hearing aids, one for each of the ears of a user. In a preferred embodiment of a binaural hearing system, the sound signals of the respective environment sound inputs are wirelessly transmitted between the two hearing aids of the binaural hearing system. The spatial filterbank in this case can have a better resolution as more sound signals can be processed by the spatial filterbank, e.g., four sound signals from, e.g., two microphones in each hearing aid. In an alternative embodiment of a binaural hearing system detection decisions, e.g., voice signal detection and/or target signal detection, or their underlying statistics, e.g. signal-to-noise ratio (SNR) are transmitted between the hearing aids of the binaural hearing system. In this case the resolution of the respective hearing aid can be improved by using the sound signals of the respective hearing aid in dependence on the information received by the other hearing aid. Using the information of the other hearing aid instead of transmitting and receiving complete sound signals decreases the computational demand in terms of bit rate and/or battery usage.

In a preferred embodiment the spatial filterbank comprises at least one beamformer. Preferably the spatial filterbank comprises several beamformers which can be operated in parallel to each other. Each beamformer is preferably configured to process the sound signals by generating a spatial sound signal, i.e., a beam, which represents sound coming from a respective subspace. A beam in this text is the combination of sound signals generated from, e.g., two or more microphones. A beam can be understood as the sound signal produced by a combination of two or more microphones into a single directional microphone. The combination of the microphones generates a directional response called a beampattern. A respective beampattern of a beamformer corresponds to a respective subspace. The subspaces are preferably cylinder sectors and can also be spheres, cylinders, pyramids, dodecahedra or other geometrical structures that allow to divide a space into subspaces. The subspaces preferably add up to the total space, meaning that the subspaces fill the total space completely and do not overlap, i.e., the beampatterns "add up to 1" such as it is preferably done in standard spectral perfect-reconstruction filterbanks. The addition of the respective subspaces to a summed subspace can also exceed the total space or occupy a smaller space than the total space, meaning that there can be empty spaces between subspaces and/or overlap of subspaces. The subspaces can be spaced differently. Preferably the subspaces are equally spaced.

In one embodiment the electric circuitry comprises a voice activity detection unit. The voice activity detection unit is preferably configured to determine whether a voice signal is present in a respective spatial sound signal. The voice detection unit preferably has at least two detection modes. In a binary mode the voice activity detection unit is configured to make a binary decision between "voice present" or "voice absent" in a spatial sound signal. In a continuous mode the voice activity detection unit is configured to estimate a probability for the voice signal to be present in the spatial sound signal, i.e., a number between 0 and 1. The voice activity detection unit can also be applied to one or more of the sound signals or the total space sound signal generated by the environment sound input. The detection whether a voice signal is present in a sound signal by the voice activity unit can be performed by a method known in the art, e.g., by using a means to detect whether harmonic structure and synchronous energy is present in the sound signal and/or spatial sound signal. The harmonic structure and synchronous energy indicates a voice signal, as vowels have unique characteristics consisting of a fundamental tone and a number of harmonics showing up synchronously in the frequencies above the fundamental tone. The voice activity detection unit can be configured to continuously detect whether a voice signal is present in a sound signal and/or spatial sound signal. The electric circuitry preferably comprises a sound parameter determination unit which is configured to determine a sound level and/or signal-to-noise ratio of a sound signal and/or spatial sound signal and/or if a sound level and/or signal-to-noise ratio of a sound signal and/or spatial sound signal is above a predetermined threshold. The voice activity detection unit can be configured only to be activated to detect whether a voice signal is present in a sound signal and/or spatial sound signal when the sound level and/or signal-to-noise ratio of a sound signal and/or spatial sound signal is above a predetermined threshold. The voice activity detection unit and/or the sound parameter determination unit can be a unit in the electric circuitry or an algorithm performed in the electric circuitry.

In one embodiment the electric circuitry comprises a noise detection unit. The noise detection unit is preferably configured to determine whether a noise signal is present in a respective spatial sound signal. In an embodiment, the noise detection unit is adapted to estimate a level of noise at a given point in time (e.g. in individual frequency bands). The noise detection unit preferably has at least two detection modes. In the binary mode the noise detection unit is configured to make a binary decision between "noise present" or "noise absent" in a spatial sound signal. In a continuous mode the noise detection unit is configured to estimate a probability for the noise signal to be present in the spatial sound signal, i.e., a number between 0 and 1 and/or to estimate the noise signal, e.g., by removing voice signal components from the spatial sound signal. The noise detection unit can also be applied to one or more of the sound signals and/or the total space sound signal generated by the environment sound input. The noise detection unit can be arranged downstream to the spatial filterbank, the beamformer, the voice activity detection unit and/or the sound parameter determination unit. Preferably the noise detection unit is arranged downstream to the voice activity detection unit and configured to determine whether a noise signal is present in a respective spatial sound signal. The noise detection unit can be a unit in the electric circuitry or an algorithm performed in the electric circuitry.

In a preferred embodiment the electric circuitry comprises a control unit. The control unit is preferably configured to adaptively adjust subspace parameters (defining a configuration of subspaces), e.g., extension, number, and/or location coordinates, of the subspaces according to the outcome of the voice activity detection unit, sound parameter determination unit and/or the noise detection unit. The adjustment of the extension of the subspaces allows to adjust the form or size of the subspaces. The adjustment of the number of subspaces allows to adjust the sensitivity, respectively resolution and therefore also the computational demands of the hearing system. Adjusting the location coordinates of the subspaces allows to increase the sensitivity at a certain location coordinate or direction in exchange for a decreased sensitivity for other location coordinates or directions. The control unit can for example increase the number of subspaces and decrease the extension of subspaces around a location coordinate of a subspace comprising a voice signal and decrease the number of subspaces and increase the extension of subspaces around a location coordinate of a subspace with a noise signal, with an absence of a sound signal or with a sound signal with a sound level and/or signal-to-noise ratio below a predetermined threshold. This can be favourable for the hearing experience as a user gets a better spatial resolution in a certain direction of interest, while other directions are temporarily of lesser importance. In a preferred embodiment of the hearing system the number of subspaces is kept constant and only the location coordinates and extensions of the subspaces are adjusted, which keeps a computational demand of the hearing system about constant.

In a preferred embodiment the electric circuitry comprises a spatial sound signal selection unit. The spatial sound signal selection unit is preferably configured to select one or more spatial sound signals and to generate an output sound signal from the selected one or more spatial sound signals. The selection of a respective spatial sound signal can for example be based on the presence of a voice signal or noise signal in the respective spatial sound signal, a sound level and/or a signal-to-noise ratio (SNR) of the respective spatial sound signal. The spatial sound signal selection unit is preferably configured to apply different weights to the one or more spatial sound signals before or after selecting spatial sound signals and to generate an output sound signal from the selected and weighted one or more spatial sound signals. The weighting of the spatial sound signals can be performed on spatial sound signals representing different frequencies and/or spatial sound signals coming from different subspaces, compare also K. L. Bell, et al, "A Bayesian Approach to Robust Adaptive Beamforming," IEEE Trans. Signal Processing, Vol. 4, No. 2, February 2000. Preferably the output transducer is configured to stimulate hearing of a user in dependence of the output sound signal. The spatial sound signal selection unit can be a unit in the electric circuitry or an algorithm performed in the electric circuitry.

In one embodiment the electric circuitry comprises a noise reduction unit. The noise reduction unit is preferably configured to reduce noise in one or more spatial sound signals. Noise reduction for the noise reduction unit is meant as a post-processing step to the noise reduction already performed by spatial filtering and/or beamforming in the spatial filterbanks with beamformers, e.g., by subtracting a noise signal estimated in the noise detection unit. The noise reduction unit can also be configured to reduce noise in the sound signals received by the environment sound input unit and/or the total space sound signal generated from the sound signals. The noise reduction unit can be a unit in the electric circuitry or an algorithm performed in the electric circuitry.

In a preferred embodiment the electric circuitry comprises a user control interface, e.g., a switch, a touch sensitive display, a keyboard, a sensoric unit connected to the user or other control interfaces operable by a user, e.g. fully or partially implemented as an APP of a SmartPhone or similar portable device. The user control interface is preferably configured to allow a user to adjust the subspace parameters of the subspaces. The adjustment of the subspace parameters can be performed manually by the user or the user can select between different modes of operation, e.g., static mode without adaption of the subspace parameters, adaptive mode with adaption of the subspace parameters according to the environment sound received by the environment sound input, i.e., the acoustic environment, or limited-adaptive mode with adaption of the subspace parameters to the acoustic environment which are limited by predetermined limiting parameters or limiting parameters determined by the user. Limiting parameters can for example be parameters that limit a maximal or minimal number of subspaces or the change of the number of subspaces used for the spatial hearing, a maximal or minimal change in extension, minimal or maximal extension, maximal or minimal location coordinates and/or a maximal or minimal change of location coordinates of subspaces. Other modes like modes which fix certain subspaces, e.g., subspaces in front direction and allow other subspaces to be adapted are also possible. In an embodiment, the configuration of subspaces is fixed. In an embodiment, at least one of the subspaces of the configuration of subspaces is fixed. In an embodiment, the configuration of subspaces is dynamically determined. In an embodiment, at least one of the subspaces of the configuration of subspaces is dynamically determined. In an embodiment, the hearing system is configured to provide a configuration of subspaces, wherein at least one subspace is fixed (e.g. located in a direction towards a known target location, e.g. in front of the user), and wherein at least one subspace is adaptively determined (e.g. determined according to the acoustic environment, e.g. in other directions than a known target location, e.g. predominantly to the rear of the user, or predominantly to the side (e.g. +/−90 off the front direction of the user, the front direction being e.g. defined as the look direction of the user). In an embodiment, two or more subspaces are fixed (e.g. to two or more known (or estimated) locations of target sound sources. In an embodiment, two or more subspaces are adaptively determined. In an embodiment, the extension of the total space around the user (considered by the present disclosure) is limited by the acoustic propagation of sound, e.g. determined by the reception of sound from a given source of a certain minimum level at the site of the user. In an embodiment, the extension of the total space around the user is less than 50 m, such as less than 20 m, or less than 5 m. In an embodiment, the extension of the total space around the user is determined by the extension of the room wherein the user is currently located.

In one embodiment the electric circuitry comprises a spectral filterbank. The spectral filterbank is preferably configured to divide the sound signals in frequency bands. The sound signals in the frequency bands can be processed in the spatial filterbank, a beamformer, the sound parameter determination unit, the voice activity detection unit, the noise reduction unit, and/or the spatial signal selection unit. The spatial filterbank can be a unit in the electric circuitry or an algorithm performed in the electric circuitry.

In an embodiment, the hearing system is configured to analyse the acoustic field in a space around a user (sound signals representing sound of the environment) in at least two steps using first and second different configurations of subspaces by the spatial filterbank in the first and second steps, respectively, and where the second configuration is derived from an analysis of the spatial sound signals of the first configuration of subspaces. In an embodiment, the hearing system is configured to select a special sound signal of a particular subspace based on a (first) predefined criterion, e.g. regarding characteristics of the spatial sound signals of the configuration of subspaces, e.g. based on signal to noise ratio. In an embodiment, the hearing system is configured to select one or more subspaces of the first configuration for further subdivision to provide the second configuration of subspaces, e.g. based on the (first) predefined criterion. In an embodiment, the hearing system is configured to base a decision on whether a further subdivision of subspaces should be performed on a second predefined criterion. In an embodiment, the second predefined criterion is based on a signal to noise ratio of the spatial sound signals, e.g. that the largest S/N determined for a spatial sound signal of a given configuration of subspaces is larger than a threshold value and/or that a change in the largest S/N determined for a spatial sound signal from one configuration of subspaces to the next configuration of subspaces is smaller than a predetermined value.

The hearing system according to the invention may comprise any type of hearing aid. The terms 'hearing aid' and 'hearing aid device' are used interchangeably in the present application.

In the present context, a "hearing aid device" refers to a device, such as e.g. a hearing aid, a listening device or an active ear-protection device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears.

A "hearing aid device" further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve and/or to the auditory cortex of the user.

A hearing aid device may be configured to be worn in any known way, e.g. as a unit arranged behind the ear with a tube leading air-borne acoustic signals into the ear canal or with a loudspeaker arranged close to or in the ear canal, as a unit entirely or partly arranged in the pinna and/or in the ear canal, as a unit attached to a fixture implanted into the skull bone, as an entirely or partly implanted unit, etc. A hearing aid device may comprise a single unit or several units communicating electronically with each other.

More generally, a hearing aid device comprises an input transducer for receiving an acoustic signal from a user's surroundings and providing a corresponding input audio signal and/or a receiver for electronically receiving an input audio signal, a signal processing circuit for processing the input audio signal and an output means for providing an audible signal to the user in dependence on the processed audio signal. Some hearing aid devices may comprise multiple input transducers, e.g. for providing direction-dependent audio signal processing. A forward path is defined by the input transducer(s), the signal processing circuit, and the output means.

In some hearing aid devices, the receiver for electronically receiving an input audio signal may be a wireless receiver. In some hearing aid devices, the receiver for electronically receiving an input audio signal may be e.g. an input amplifier for receiving a wired signal. In some hearing aid devices, an amplifier may constitute the signal processing circuit. In some hearing aid devices, the output means may comprise an output transducer, such as e.g. a loudspeaker for providing an air-borne acoustic signal or a vibrator for providing a structure-borne or liquid-borne acoustic signal. In some hearing aid devices, the output means may comprise one or more output electrodes for providing electric signals.

In some hearing aid devices, the vibrator may be adapted to provide a structure-borne acoustic signal transcutaneously or percutaneously to the skull bone. In some hearing aid devices, the vibrator may be implanted in the middle ear and/or in the inner ear. In some hearing aid devices, the vibrator may be adapted to provide a structure-borne acoustic signal to a middle-ear bone and/or to the cochlea. In some hearing aid devices, the vibrator may be adapted to provide a liquid-borne acoustic signal in the cochlear liquid, e.g. through the oval window. In some hearing aid devices, the output electrodes may be implanted in the cochlea or on the inside of the skull bone and may be adapted to provide the electric signals to the hair cells of the cochlea, to one or more hearing nerves and/or to the auditory cortex.

A "hearing aid system" refers to a system comprising one or two hearing aid devices, and a "binaural hearing aid system" refers to a system comprising two hearing aid devices and being adapted to cooperatively provide audible signals to both of the user's ears. Hearing aid systems or binaural hearing aid systems may further comprise "auxiliary devices" (here e.g. termed an 'external device'), which communicate with the hearing aid devices and affect and/or benefit from the function of the hearing aid devices. Auxiliary devices may be e.g. remote controls, remote microphones, audio gateway devices, mobile phones (e.g. smartphones), public-address systems, car audio systems or music players. Hearing aid devices, hearing aid systems or binaural hearing aid systems may e.g. be used for compensating for a hearing-impaired person's loss of hearing capability, augmenting or protecting a normal-hearing person's hearing capability and/or conveying electronic audio signals to a person.

The hearing aid device may preferably comprise a first wireless interface comprising first antenna and transceiver circuitry adapted for establishing a communication link to an external device and/or to another hearing aid device based on near-field communication (e.g. inductive, e.g. at frequencies below 100 MHz) and/or a second wireless interface comprising second antenna and transceiver circuitry adapted for establishing a second communication link to an external device and/or to another hearing aid device based on far-field communication (radiated fields (RF), e.g. at frequencies above 100 MHz, e.g. around 2.4 or 5.8 GHz).

The invention further resides in a method comprising a step of receiving sound signals representing sound of an environment. Preferably, the method comprises a step of using the sound signals to generate spatial sound signals. Each of the spatial sound signals represents sound coming from a subspace of a total space. The method can alternatively comprise a step of dividing the sound signals in subspaces generating spatial sound signals. A further alternative method comprises a step of generating a total space sound signal from the sound signals and dividing the total space sound signal in subspaces of the total space generating spatial sound signals. The method further preferably comprises a step of detecting whether a voice signal is present in a respective spatial sound signal for all spatial sound signals. The step of detecting whether a voice signal is present in a respective spatial sound signal can be performed one after another for each of the spatial sound signals or is preferably performed in parallel for all spatial sound signals. Preferably, the method comprises a step of selecting spatial sound signals with a voice signal above a predetermined signal-to-noise ratio threshold. The step of selecting spatial sound signals with a voice signal above a predetermined signal-to-noise ratio threshold can be performed one after another for each of the spatial sound signals or is preferably performed in parallel for all spatial sound signals. The spatial sound signals can also be selected based on a sound level threshold or a combination of a sound level threshold and a signal-to-noise ratio threshold. Further in one embodiment spatial sound signals can be selected, which do not comprise a voice signal. The method further preferably comprises a step of generating an output sound signal from the selected spatial sound signals.

A preferred embodiment of the method comprises a step of dividing the sound signals in frequency bands. Dividing the sound signals in frequency bands is preferably performed prior to generating spatial sound signals. The method can comprise a step of reducing noise in the sound signals in the frequency bands and/or noise in the spatial sound signals. Preferably the method comprises a step of reducing noise in the selected spatial sound signals. Preferably the step of reducing noise in the selected spatial sound signals is performed in parallel for all selected spatial sound signals.

In a preferred embodiment the method comprises a step of adjusting subspace parameters of the subspaces. Subspace parameters comprise the extension of the subspace, the number of subspaces and the location coordinates of the subspaces. Preferably the adjusting of the subspace parameters of the subspaces is performed in response to the detection of a voice signal or noise signal in a selected spatial sound signal, spatial sound signal or sound signal. The adjusting of the subspace parameters can also be performed manually, e.g., by a user.

A preferred embodiment of the method can be used to determine a location of a sound source. The method preferably comprises a step of receiving sound signals. Preferably the method comprises a step of using the sounds signals and subspace parameters to generate spatial sound signals representing sound coming from a subspace of a total space. The subspaces preferably fill the total space in this embodiment of the method. The method preferably comprises a step of determining a sound level and/or signal-to-noise ratio (SNR) in each spatial sound signal. Preferably, the method comprises a step of adjusting the subspace parameters of the subspaces, which are used for the step of generating the spatial sound signals. The subspace parameters are preferably adjusted such that sensitivity around subspaces with high sound level and/or high signal-to-noise ratio (SNR) is increased and sensitivity around subspaces with low sound level and/or low SNR is decreased. The sensitivity here is to be understood as a resolution of the space, meaning that a higher number of smaller subspaces is arranged in spaces around a sound source, while only a small number of larger subspaces is arranged around or at spaces without a sound source. The method preferably comprises a step of identifying a location of a sound source. The identification of a location of a sound source can depend on a predetermined sound level threshold and/or a predetermined SNR threshold. To reach the predetermined sound level and/or the SNR the method is preferably configured to repeat all steps of the method iteratively until the predetermined sound level and/or the SNR is achieved. The method can also be configured to iteratively adjust the subspace parameters until a change of the subspace parameters is below a threshold value for the change of the sound level and/or the SNR. If the change of the sound level and/or the SNR caused by adjusting the subspace parameters is below a threshold value the location of a sound source is preferably identified as the spatial sound signal with the highest sound level and/or SNR.

In an embodiment, a standard configuration of subspaces is used as an initial configuration. Then sound parameters for all subspaces (spatial sound signals) are determined, e.g., sound level. The subspace with, e.g., highest sound level is the subspace with highest sound source location probability. Then in an iteration step, the subspace with highest sound source location probability is adjusted by, e.g., dividing it in smaller subspaces. The sound level of the smaller subspaces is identified. This is performed until a sound source is located to a degree acceptable for the method or user.

Preferably, the method to determine a location of a sound source comprises a step of determining whether a voice signal is present in the spatial sound signal corresponding to the location of the sound source. If a voice signal is present in the spatial sound signal corresponding to the location of the sound source the method can generate an output sound signal from the spatial sound signal comprising the voice signal and/or spatial sound signals of neighbouring subspaces comprising the voice signal. The output sound signal can be used to stimulate the hearing of a user. Alternatively if no voice signal is present the method preferably comprises a step of identifying another location of a sound source. Preferably the method is performed on a hearing system comprising a memory. After identifying a location of a sound source the method can be manually restarted to identify other sound source locations.

Preferably, the methods described above are performed using the hearing system according to the invention. Further methods can obviously be performed using the features of the hearing system.

The hearing system is preferably configured to be used for sound source localization. The electric circuitry of the hearing system preferably comprises a sound source localization unit. The sound source localization unit is preferably configured to decide if a target sound source is present in a respective subspace. The hearing system preferably comprises a memory configured to store data, e.g., location coordinates of sound sources or subspace parameters, e.g., location coordinates, extension and/or number of subspaces. The memory can also be configured to temporarily store all or a part of the data. The memory is preferably configured to delete the location coordinates of a sound source after a predetermined time, such as 10 seconds, preferably 5 seconds or more preferably 3 seconds.

In a preferred embodiment of the hearing system all detection units are configured to run a hard and a soft mode. The hard mode corresponds to a binary mode, which performs binary decisions between "present" or "not present" for a certain detection event. The soft mode is a continuous mode, which estimates a probability for a certain detection event, i.e., a number between 0 and 1.

The present invention will be more fully understood from the following detailed description of embodiments thereof, taken together with the drawings in which.

Figure 1:
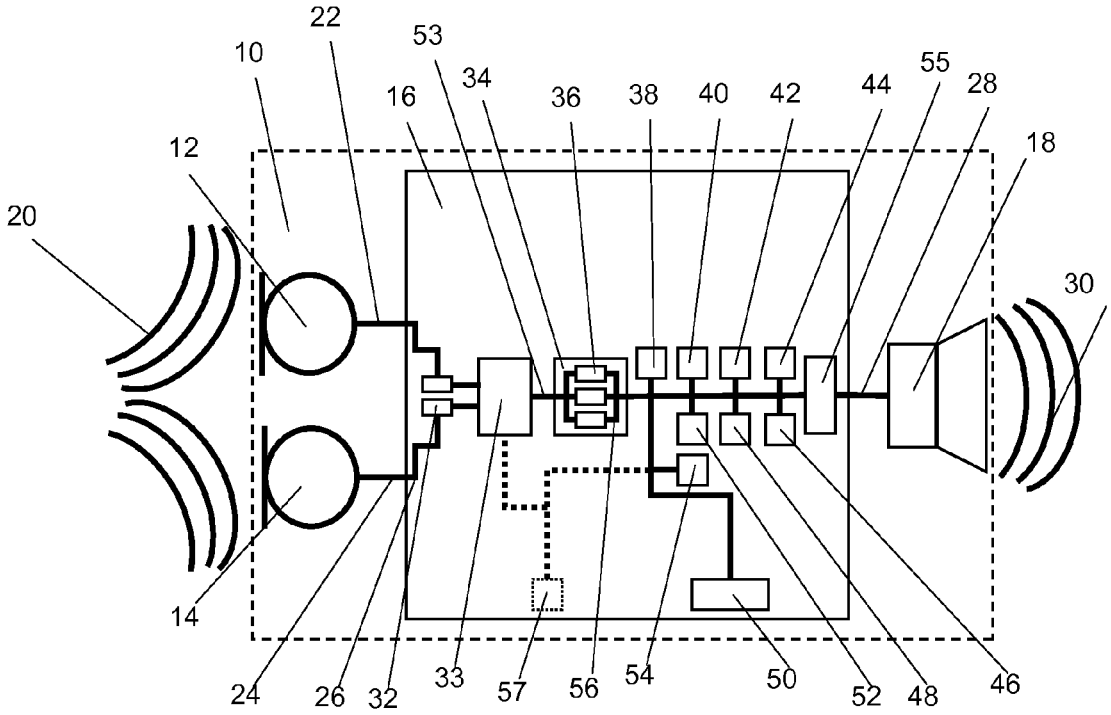
FIG. 1 shows a schematic illustration of an embodiment of a hearing system.

FIG. 1 shows a hearing system 10 comprising a first microphone 12, a second microphone 14, electric circuitry 16, and a speaker 18. The hearing system 10 can also comprise one environment sound input unit that comprises the microphones 12 and 14 or an array of microphones or other sound inputs which are configured to receive incoming sound and generate sound signals from the incoming sound (not shown). Additionally or alternatively to the speaker 18 a cochlear implant can be present in the hearing system 10 or an output transducer configured to stimulate hearing of a user (not shown). The hearing system can also be a binaural hearing system comprising two hearing systems 10 with a total of four microphones (not shown). The hearing system 10 in the embodiment presented in FIG. 1 is a hearing aid, which is configured to stimulate the hearing of a hearing impaired user.

Incoming sound 20 from the environment, e.g., from several sound sources is received by the first microphone 12 and the second microphone 14 of the hearing device 10. The first microphone 12 generates a first sound signal 22 representing the incoming sound 20 at the first microphone 12 and the second microphone 14 generates a second sound signal 24 representing the incoming sound 20 at the second microphone 14. The sound signals 22 and 24 are provided to the electric circuitry 16 via a line 26. In this embodiment the line 26 is a wire that transmits electrical sound signals. The line 26 can also be a pipe, glass fibre or other means for signal transmission, which is configured to transmit data and sound signals, e.g., electrical signals, light signals or other means for data communication. The electric circuitry 16 processes the sound signals 22 and 24 generating an output sound signal 28. The speaker 18 generates an output sound 30 in dependence of the output sound signal 28.

In the following we describe an exemplary path of processing of the sound signals 22 and 24 in the electric circuitry 16. The electric circuitry 16 comprises a spectral filterbank 32, a sound signal combination unit 33 and a spatial filterbank 34 which comprises several beamformers 36. The electric circuitry 16 further comprises a voice activity detection unit 38, a sound parameter determination unit 40, a noise detection unit 42, a control unit 44, a spatial sound signal selection unit 46, a noise reduction unit 48, a user control interface 50, a sound source localization unit 52, a memory 54, and an output sound processing unit 55. The arrangement of the units in the electric circuitry 16 in FIG. 1 is only exemplary and can be easily optimized by the person skilled in the art for short communication paths if desired.

The processing of the sound signals 22 and 24 in the electric circuitry 16 starts with the spectral filterbanks 32. The spectral filterbanks 32 divide the sound signals 22 and 24 in frequency bands by band-pass filtering copies of the sound signals 22 and 24. The division in frequency bands by band-pass filtering of the respective sound signal 22 and 24 in the respective spectral filterbank 32 can be different in the two spectral filterbanks 32. It is also possible to arrange more spectral filterbanks 32 in the electric circuitry 16, e.g., spectral filterbanks 32 which process sound signals of other sound inputs (not shown). Each of the spectral filterbanks 32 can further comprise rectifiers and/or filters, e.g., low-pass filters or the like (not shown). The sound signals 22 and 24 in the frequency bands can be used to derive spatial information, e.g., by cross correlation calculations. The sound signals 22 and 24 in the frequency bands, i.e., the outputs of the spectral filterbanks 32, are then combined in the sound signal combination unit 33. In this embodiment the sound signal combination unit 33 is configured to generate total subspace sound signals 53 for each frequency band by a linear combination of time-delayed sub-band sound signals, meaning a linear combination of sound signal 22 and sound signal 24 in a respective frequency band. The sound signal combination unit 33 can also be configured to generate a total subspace sound signal 53 or a total subspace sound signal 53 for each frequency band by other methods known in the art to combine the sound signals 22 and 24 in the frequency bands. This allows to perform spatial filtering for each frequency band.

Each total subspace sound signal 53 in a frequency band is then provided to the spatial filterbank 34. The spatial filterbank 34 comprises several beamformers 36. The beamformers 36 are operated in parallel to each other. Each beamformer is configured to use the total subspace sound signal 53 in a respective frequency band to generate a spatial sound signal 56 in a respective frequency band. Each beamformer can also be configured to use a total subspace sound signal 56 summed over all frequency bands to generate a spatial sound signal 56. Each of the spatial sound signals 56 represents sound coming from a subspace 58 of a total space 60 (see FIGS. 2A-2E). The total space 60 is the complete surrounding of a user 62, i.e., the acoustic environment (see FIGS. 2A-2E).

In the following we describe an example situation where the spatial filterbank 34 is especially useful, i.e., a situation in which the sound scene changes, e.g., by occurrence of a new sound source. We here compare our hearing system 10 with a standard hearing aid without a spatial filterbank that has a single beamformer with a beam pointing in front direction, meaning that the hearing aid mainly receives sound from the front of the head of a user wearing the standard hearing aid. Without the spatial filterbank 34 the user needs to determine the location of the new sound source and adjust the subspace parameters accordingly to receive sound signals. In a sound scene change the beam has to be adjusted from an initial subspace to the subspace of the sound source, meaning that the user wearing the hearing aid has to turn his head from an initial direction to the direction of the new sound source. This takes time and the user risks that he misses, e.g., the onset of the speech of a new talker. With the spatial filterbank 34, the user already has a beam pointing in the direction or subspace of the sound source; all the user or hearing system 10 needs to do is to decide to feed the respective spatial sound signal 56, i.e., the respective beamformer output to the user 62.

The spatial filterbank 34 further allows for soft-decision schemes, where several spatial sound signals 56 from different subspaces 58, i.e., beamformer outputs from different directions, can be used to generate an output sound signal 28 at the same time. Instead of a hard-decision in terms of listening to one and only one spatial sound signal 56, it is, e.g., possible to listen to 30% of a spatial sound signal 56 representing a subspace 58 in front of a user, 21% of a second spatial sound signal 56 representing a second subspace 58, and 49% of a third spatial sound signal 56 representing a third subspace 58. Such an architecture is useful for systems, where target signal presence in a given subspace or direction is expressed in terms of probabilities. The underlying theory for such a system has been developed in, e.g., K. L. Bell, et al, "A Bayesian Approach to Robust Adaptive Beamforming," IEEE Trans. Signal Processing, Vol. 4, No. 2, February 2000.

There can also be more than one spatial filterbank 34. The spatial filterbank 34 can also be a spatial filterbank algorithm. The spatial filterbank algorithm can be executed as a spatial filterbank 34 online in the electric circuitry 16 of the hearing system 10. The spatial filterbank 34 in the embodiment of FIG. 1 uses the Fast Fourier Transform for computing the spatial sound signals 56, i.e., beams. The spatial filterbank 34 can also use other means, i.e., algorithms for computing the spatial sound signals 56.

The spatial sound signals 56 generated by the spatial filterbank 34 are provided to the voice activity detection unit 38 for further processing. Each of the spatial sound signals 56 is analysed in the voice activity detection unit 38. The voice activity detection unit 38 detects whether a voice signal is present in the respective spatial sound signal 56. The voice detection unit 38 is configured to perform to modes of operation, i.e., detection modes. In a binary mode the voice activity detection unit 38 is configured to make a binary decision between "voice present" or "voice absent" in a spatial sound signal 56. In a continuous mode the voice activity detection unit 38 is configured to estimate a probability for the voice signal to be present in the spatial sound signal 56, i.e., a number between 0 and 1. The voice detection is performed according to methods known in the art, e.g., by using a means to detect whether harmonic structure and synchronous energy is present in the respective spatial sound signal 56, which indicates a voice signal, as vowels have unique characteristics consisting of a fundamental tone and a number of harmonics showing up synchronously in the frequencies above the fundamental tone. The voice activity detection unit 38 can be configured to continuously detect whether a voice signal is present in the respective spatial sound signal 56 or only for selected spatial sound signals 56, e.g., spatial sound signals 56 with a sound level above a sound level threshold and/or spatial sound signals 56 with a signal-to-noise ratio (SNR) above a SNR threshold. The voice activity detection unit 38 can be a unit in the electric circuitry 16 or an algorithm performed in the electric circuitry 16.

Voice activity detection (VAD) algorithms in common systems are typically performed directly on a sound signal, which is most likely noisy. The processing of the sound signals with a spatial filterbank 34 results in spatial sound signals 56 which represent sound coming from a certain subspace 58. Performing independent VAD algorithms on each of the spatial sound signals 56 allows easier detection of a voice signal in a subspace 58, as potential noise signals from other subspaces 58 have been rejected by the spatial filterbank 34. Each of the beamformers 36 of the spatial filterbank 34 improves the target signal-to-noise signal ratio. The parallel processing with several VAD algorithms allows the detection of several voice signals, i.e., talkers, if they are located in different subspaces 58, meaning that the voice signal is in a different spatial sound signals 56.The spatial sound signals 56 are then provided to the sound parameter determination unit 40. The sound parameter determination unit 40 is configured to determine a sound level and/or signal-to-noise ratio of a spatial sound signal and/or if a sound level and/or signal-to-noise ratio of a spatial sound signal 56 is above a predetermined threshold. The sound parameter determination unit 40 can be configured to only determine sound level and/or signal-to-noise ratio for spatial sound signals 56 which comprise a voice signal.

The spatial sound signals 56 can alternatively be provided to the sound parameter determination unit 40 prior to the voice activity detection unit 38. Then the voice activity detection unit 38 can be configured only to be activated to detect whether a voice signal is present in a spatial sound signal 56 when the sound level and/or signal-to-noise ratio of a spatial sound signal 56 is above a predetermined threshold. The sound parameter determination unit 40 can be a unit in the electric circuitry 16 or an algorithm performed in the electric circuitry 16.

The spatial sound signals 56 are then provided to the noise detection unit 42. The noise detection unit 42 is configured to determine whether a noise signal is present in a respective spatial sound signal 56. The noise detection unit 42 can be a unit in the electric circuitry 16 or an algorithm performed in the electric circuitry 16.

The spatial sound signals 56 are then provided to the control unit 44. The control unit 44 is configured to adaptively adjust the subspace parameters, e.g., extension, number, and/or location coordinates of the subspaces according to the outcome of the voice activity detection unit 38, sound parameter determination unit 40 and/or the noise detection unit 42. The control unit 44 can for example increase the number of subspaces 58 and decrease the extension of subspaces 58 around a location coordinate of a subspace 58 comprising a voice signal and decrease the number of subspaces 58 and increase the extension of subspaces 58 around a location coordinate of a subspace 58 with a noise signal, with an absence of a sound signal 22 or 24 or with a sound signal 22 or 24 with a sound level and/or signal-to-noise ratio below a predetermined threshold. This can be favourable for the hearing experience as a user gets a better spatial resolution in a certain direction of interest, while other directions are temporarily of lesser importance.

The spatial sound signals 56 are then provided to the spatial sound signal selection unit 46. The spatial sound signal selection unit 46 is configured to select one or more spatial sound signals 56 and to generate a weight parameter value for the one or more selected spatial sound signals 56. The weighting and selection of a respective spatial sound signal 56 can for example be based on the presence of a voice signal or noise signal in the respective spatial sound signal 56, a sound level and/or a signal-to-noise ratio (SNR) of the respective spatial sound signal 56. The spatial sound signal selection unit 46 can be a unit in the electric circuitry 16 or an algorithm performed in the electric circuitry 16.

The spatial sound signals 56 are then provided to the noise reduction unit 48. The noise reduction unit 48 is configured to reduce the noise in the spatial sound signals 56 selected by the spatial sound signal selection unit 46. Noise reduction in the noise reduction unit 48 is a post-processing step, e.g., a noise signal is estimated and subtracted from a spatial sound signal 56. Alternatively all spatial sound signals 56 can be provided to the noise reduction unit 48, which then reduces the noise in one or more spatial sound signals 56. The noise reduction unit 48 can be a unit in the electric circuitry 16 or an algorithm performed in the electric circuitry 16.

The spatial sound signals 56 are finally provided to the output sound processing unit 55 together with all output results, e.g. weight parameters, selection of spatial sound signals 56, or other outputs determined by the foregoing units in the electric circuitry 16. The output sound processing unit 55 is configured to process the spatial sound signals 56 according to the output results of the foregoing units in the electric circuitry 16 and generate an output signal 28 in dependence of the output results of the foregoing units in the electric circuitry 16. The output signal 28 is for example adjusted by, selecting spatial sound signals 56 representing subspaces 58 with voice activity, without feedback, or with/without other properties determined by the units of the electric circuitry 16. The output sound processing unit 55 is further configured to perform hearing aid processing, such as feedback cancellation, feedback suppression, and hearing loss compensation (amplification, compression) or similar processing.

The output sound signal 28 is provided to the speaker 18 in a final step. The output transducer 18 then generates an output sound 30 in dependence of the output sound signal 28.

The user 62 can control the hearing system 10 using the user control interface 50. The user control interface 50 in this embodiment is a switch. The user control interface 50 can also be a touch sensitive display, a keyboard, a sensoric unit connected to the user 62, e.g., a brain implant or other control interfaces operable by the user 62. The user control interface 50 is configured to allow the user 62 to adjust the subspace parameters of the subspaces 58. The user can select between different modes of operation, e.g., static mode without adaption of the subspace parameters, adaptive mode with adaption of the subspace parameters according to the environment sound received by the microphones 12 and 14, i.e., the acoustic environment, or limited-adaptive mode with adaption of the subspace parameters to the acoustic environment which are limited by predetermined limiting parameters or limiting parameters determined by the user 62. Limiting parameters can for example be parameters that limit a maximal or minimal number of subspaces 58 or the change of the number of subspaces 58 used for the spatial hearing, a maximal or minimal change in extension, minimal or maximal extension, maximal or minimal location coordinates and/or a maximal or minimal change of location coordinates of subspaces 58. Other modes like modes which fix certain subspaces 58 and allow other subspaces 58 to be adapted are also possible, e.g., fixing subspaces 58 in front direction and allowing the adaption of all other subspaces 58. Using an alternative user control interface can allow to adjust the subspace parameters (defining a configuration of subspaces) directly. The hearing system 10 can also be connected to an external device for controlling the hearing system 10 (not shown).

By adaptively adjusting subspace parameters the spatial filterbanks 34 become adaptive spatial filters. The term "adaptive" (in the meaning "adaptive/automatic or user-controlled") is intended to cover two extreme situations: a) signal adaptive/automatic, and b) user-controlled, i.e., the user tells the algorithm in which direction to "listen" and any soft-combination between a) and b), e.g. that the algorithm makes proposals about directions, which the human user accepts/rejects. In an embodiment, a user using the user control interface 50 can select to listen to the output of a single spatial sound signal 56, which may be adapted to another subspace 58 or subspaces 58, i.e. directions, than a frontal subspace 58. The advantage of this is that it allows the listener to select to listen to spatial sound signals 56 which represent sound 20 coming from non-frontal directions, e.g., in a car-cabin situation. A disadvantage in prior art hearing aids is that it takes time for a user, and therefore the beam to change direction, e.g., from frontal, to the side by turning the head of the hearing aid user. During the travelling time of the beam, the first syllable of a sentence may be lost, which leads to reduced intelligibility for a hearing impaired user of the prior art hearing aid. The spatial filterbank 34 covers all subspaces, i.e., directions. The user can manually select or let an automatic system decide, which spatial sound signal 56 or spatial sound signals 56 are used to generate an output sound signal 56, which is then transformed into an output sound 30, which can be presented instantly to the hearing aid user 62.

In one mode of operation the hearing system 10 allows to localize a sound source using the sound source localization unit 52. The sound source localization unit 52 is configured to decide if a target sound source is present in a respective subspace. This can be achieved using the spatial filterbank and a sound source localization algorithm which zooms in on a certain subspace or direction in space to decide if a target sound source is present in the respective subspace or direction in space. The sound source localization algorithm used in the embodiment of the hearing system 10 presented in FIG. 1 comprises the following steps.

Sound signals 22 and 24 are received.

Spatial sound signals 56 representing sound 20 coming from a subspace 58 of a total space 60 are generated using the sounds signals 22 and/or 24 and subspace parameters. The subspaces 58 in the sound source localization algorithm are chosen to fill the total space 60. A sound level, signal-to-noise ratio (SNR), and/or target signal presence probability in each spatial sound signal 56 is determined.

The subspace parameters of the subspaces 58, which are used for the step of generating the spatial sound signals 56 are adjusted. The subspace parameters are preferably adjusted such that sensitivity around subspaces 58 with high sound level and/or high signal-to-noise ratio (SNR) is increased and sensitivity around subspaces 58 with low sound level and/or low SNR is decreased. Also other adjustments of the subspaces 58 are possible.

A location of a sound source is identified. It is also possible that more than one sound source and the locations of the respective sound sources are identified. The identification of a location of a sound source depends on a predetermined sound level threshold and/or a predetermined SNR threshold. To reach the predetermined sound level and/or the SNR the sound source localization algorithm is configured to repeat all steps of the algorithm, meaning receiving sound signals 22 and 24, generating spatial sound signals 56, adjusting subspace parameters and identifying locations of a sound source, iteratively until the predetermined sound level and/or the SNR is achieved. Alternatively the sound source localization algorithm is configured to iteratively adjust the subspace parameters until a change of the subspace parameters is below a threshold value for the change of the sound level and/or the SNR. If the change of the sound level and/or the SNR caused by adjusting the subspace parameters is below a threshold value the location of a sound source is identified as the spatial sound signal 56 with the highest sound level and/or SNR. It is also possible to identify more than one sound source and locations of the respective sound sources in parallel. A further, e.g. second, sound source can be identified as the spatial sound signal 56 with the next, e.g. second, highest sound level and/or SNR. Preferably the spatial sound signals 56 of the sound sources can be compared to each other to identify whether the spatial sound signals come from an identical sound source. In this case the algorithm is configured to process only the strongest spatial sound signal 56, meaning the spatial sound signal 56 with the highest sound level and/or SNR, representing a respective sound source. Spatial sound signals 56 representing different sound sources can be processed by parallel processes of the algorithm. The total space 60 used for the location of sound sources can be limited to respective subspaces 58 for a respective process of the parallel processes to avoid two sound sources in an identical subspace 58.

If a sound source is identified the sound source localization algorithm comprises a step of using the respective spatial sound signal 56 representing the sound coming from the subspace 58 of the sound source and optionally spatial sound signals 56 representing sound coming from subspaces 58 which are in close proximity to the subspace 58 of the sound source to generate an output sound signal 28.

The sound source localization algorithm can also comprise a step of determining whether a voice signal is present in the spatial sound signal 56 corresponding to the location of the sound source.

If a voice signal is present in the spatial sound signal 56 representing the sound coming from the subspace 58 of the sound source the algorithm comprises a step of generating an output sound signal 28 from the spatial sound signal 56 comprising the voice signal and/or spatial sound signals 56 of neighbouring subspaces 58 comprising the voice signal.

Alternatively if no voice signal is present the sound source localization algorithm comprises a step of identifying another location of a sound source. After identifying a location of a sound source the sound source localization algorithm can be manually restarted to identify other sound source locations.

The memory 54 of the hearing system 10 is configured to store data, e.g., location coordinates of sound sources or subspace parameters, e.g., location coordinates, extension and/or number of subspaces 58. The memory 54 can be configured to temporarily store all or a part of the data. In this embodiment the memory 54 is configured to delete the location coordinates of a sound source after a predetermined time, such as 10 seconds, preferably 5 seconds or more preferably 3 seconds.

Relying on the parallel sound source localization algorithm above, the hearing system 10 can estimate the subspace 58, i.e. the direction, of a sound source. The direction of a target sound source is of interest, as dedicated noise reduction systems can be applied to enhance signals from this particular direction.

The spatial sound signals 56 generated by the spatial filterbank 34 can also be used for improved feedback howl detection, which is a challenge in any state-of-the-art hearing device. The howling results due to feedback of the loudspeaker signal to the microphone(s) of a hearing aid. The hearing aid has to distinguish between the following two situations: i) a feedback howl, or ii) an external sound signal, e.g., a violin playing, which as a signal looks similar to a feedback howl. The spatial filterbank 34 allows to exploit the fact that feedback howls tend to occur from a particular subspace 58, i.e. direction, so that the spatial difference between a howl and the violin playing can be exploited for improved howl detection.

The electric circuitry 16 of the hearing system 10 can comprise a transceiver unit 57. In the embodiment shown in FIG. 1 the electric circuitry 16 does not comprise a transceiver unit 57. The transceiver unit 57 can be configured to transmit data and sound signals to another hearing system 10, speakers in another persons hearing aid, in mobile phones, in laptops, in hearing aid accessories, streamers, tv-boxes or other systems comprising a means to receive data and sound signals and receive data and sound signals from another hearing system 10, an external microphone, external microphones, e.g., microphones in a hearing aid of another user, in mobile phones, in laptops, in hearing aid accessories, audio streamers, audio gateways, tv-boxes e.g. for wirelessly transmitting TV sound, or other systems comprising a means to generate a data and/or sound signal and to transmit data and sound signals. In the case of two hearing systems 10 connected to each other the hearing systems 10 form a binaural hearing system. All filterbanks and/or units, meaning 32, 34, 36, 40, 42, 44, 46, 48, 50, 52, and/or 54 of the electric circuitry 16 can be configured for binaural usage. All of the units can be improved by combining the output of the units binaurally. The spatial filterbanks 34 of the two hearing systems can be extended to binaural filter banks or the spatial filterbanks 34 can be used as binaural filterbanks, i.e., instead of using 2 local microphones 12 and 14, the binaural filter banks are configured to use four sound signals of four microphones. The binaural usage improves the spectral and spatial sensitivity, i.e., resolution of the hearing system 10. A potential transmission time delay between the transceiver units 57 of the two hearing systems 10, which can typically be between 1 to 15 ms depending on the transmitted data, is of no practical concern, as the sound source localization units 52 are used for sound source localization or voice activity detection units 38 are used for detection purpose in the case of binaural usage of the hearing system. The spatial sound signals 56 are then selected in dependence of the output of the respective units. The decisions of the units can be delayed 15 ms without any noticeable performance degradations. In another embodiment the output sound signal is generated from the output of the units. The units, filterbanks and/or beamformers can also be algorithms performed on the electric circuitry 16 or a processor of the electric circuitry 16 (not shown).

Figure 2A:
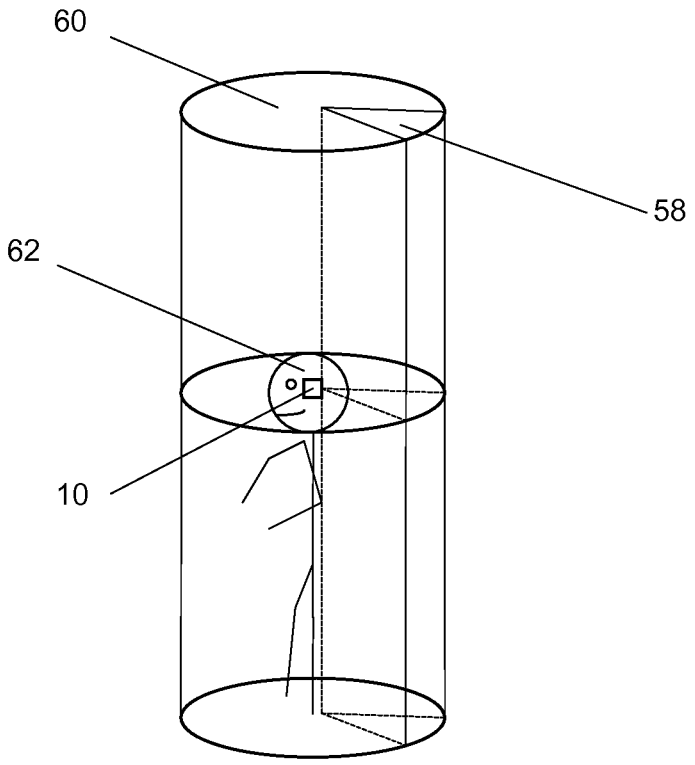
FIGS. 2A-2E show schematic illustrations of an embodiment of a hearing system worn by a user listening to sound from a subspace of a total space of the sound environment (FIG. 2A) and four different configurations of subspaces (FIGS. 2B, 2C, 2D, 2E)
Figure 2B:
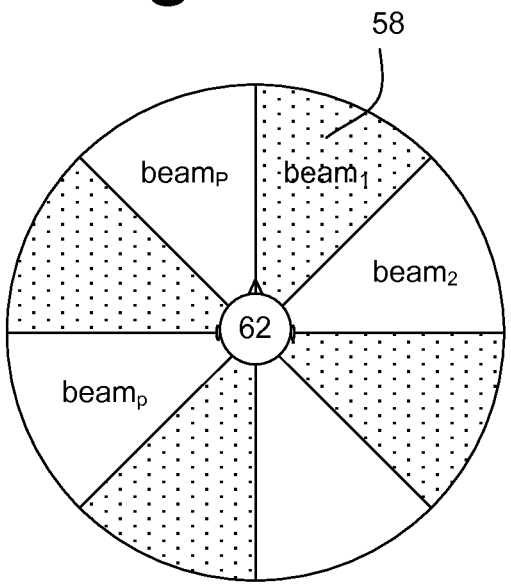

FIG. 2A shows the hearing system of FIG. 1 worn by a user 62. The total space 60 in this embodiment is a cylinder volume, but may alternatively have any other form. The total space 60 can also for example be represented by a sphere (or semi-sphere, a dodecahedron, a cube, or similar geometric structures. A subspace 56 of the total space 60 corresponds to a cylinder sector. The subspaces 58 can also be spheres, cylinders, pyramids, dodecahedra or other geometrical structures that allow to divide the total space 60 into subspaces 58. The subspaces 58 in this embodiment add up to the total space 60, meaning that the subspaces 58 fill the total space 60 completely and do not overlap (as e.g. schematically illustrated in FIG. 2B, each $beam_p$, p=1, 2, . . . , P, constituting a subspace (cross-section) where P (here equal to 8) is the number of subspaces 58). There can also be empty spaces between subspaces 56 and/or overlap of subspaces 56. The subspaces 56 in this embodiment are equally spaced, e.g., in 8 cylinder sectors with 45 degrees. The subspaces can also be differently spaced, e.g., one sector with 100 degree, a second sector with 50 degree and a third sector with 75 degree. In one embodiment the spatial filterbank 34 can be configured to divide the sound signals 22 and 24 in subspaces 56 corresponding to directions of a horizontal "pie", which can be divided into, e.g., 18 slices of 20 degrees with a total space 60 of 360 degrees. In this embodiment the output sound 30 presented to the user 62 by the speaker 18 is generated from an output sound signal 28 that comprises the spatial sound signal 56 representing the subspace 58 of the total space 60. The subspaces may (in particular modes of operation) be either fixed, or dynamically determined, or a mixture thereof (e.g. some fixed, other adaptively determined).

The location coordinates, extension, and number of subspaces 58 depends on subspace parameters. The subspace parameters can be adaptively adjusted, e.g., in dependence of an outcome of the voice activity detection unit 38, the sound parameter determination unit 40 and/or the noise detection unit 42. The adjustment of the extension of the subspaces 58 allows to adjust the form or size of the subspaces 58. The adjustment of the number of subspaces 58 allows to adjust the sensitivity, respectively resolution and therefore also the computational demands of the hearing system 10. Adjusting the location coordinates of the subspaces 58 allows to increase the sensitivity at certain location coordinates or direction in exchange for a decreased sensitivity for other location coordinates or directions. In the embodiment of the hearing system 10 in FIGS. 2A-2E the number of subspaces 58 is kept constant and only the location coordinates and extensions of the subspaces are adjusted, which keeps a computational demand of the hearing system about constant.

Figure 2C:
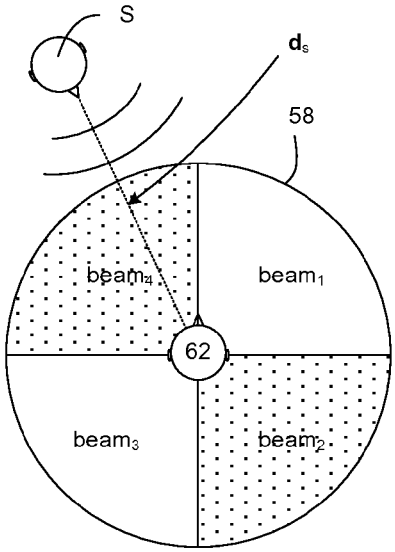
Figure 2D:
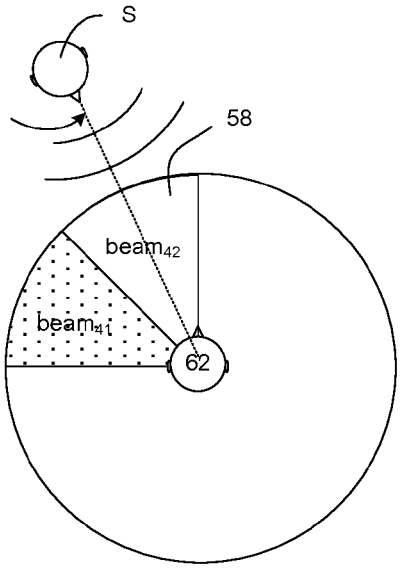

FIGS. 2C and 2D illustrate application scenarios comprising different configurations of subspaces. In FIG. 2C, the space 60 around the user 62 is divided into 4 subspaces 58, denoted $beam_1$, $beam_2$, $beam_3$, $beam_4$ in FIG. 2C. Each subspace beam comprises one fourth of the total angular space, i.e. each spanning 90° (in the plane shown), and each being of equal form and size. The subspaces need not be of equal form and size, but can in principle be of any form and size (and location relative to the user). Likewise, the subspaces need not add up to fill the total space, but may be focused on continuous or discrete volumes of the total space. In FIG. 2D, the subspace configuration comprises only a part of the space around the user 62 (here a fourth, here subspace $beam_4$ in FIG. 2C is divided into 2 subspaces 58, denoted $beam_{41}$, $beam_{42}$ in FIG. 2D).

FIGS. 2C and 2D may illustrate a scenario where the acoustic field in a space around a user is analysed in at least two steps using different configurations of the subspaces of the spatial filterbank, e.g. first and second configurations, and where the second configuration is derived from an analysis of the sound field in the first configuration of subspaces, e.g. according to a predefined criterion, e.g. regarding characteristics of the spatial sound signals of the configuration of subspaces. A sound source S is shown located in a direction represented by vector $d_s$ relative to the user 62. The spatial sound signals ($sssig_i$, i=1, 2, 3, 4) of the subspaces 58 of a given configuration of subspaces (e.g. $beam_1$, $beam_2$, $beam_3$, $beam_4$ in FIG. 2C) is e.g. analysed to evaluate characteristics of each corresponding spatial sound signal (here no prior knowledge of the location and nature of the sound source S is assumed). Based on the analysis, a subsequent configuration of subspaces is determined (e.g. $beam_{41}$, $beam_{42}$ in FIG. 2D), and the spatial sound signals ($sssig_{ij}$, i=4, j=1, 2) of the subspaces 58 of the subsequent configuration are again analysed to evaluate characteristics of each (subsequent) spatial sound signal. In an embodiment, characteristics of the spatial sound signals comprise a measure comprising signal and noise (e.g. a signal to noise signal to noise ratio). In an embodiment, characteristics of the spatial sound signals comprise a measure representative of a voice activity detection. In an embodiment, a noise level is determined in time segments where no voice is detected by the voice activity detector. In an embodiment, a signal to noise ratio (S/N) is determined for each of the spatial sound signals ($sssig_i$, i=1, 2, 3, 4). The signal to noise ratio ($S/N(sssig_4)$) of subspace $beam_4$ is the largest of the four S/N-values of FIG. 2C, because the sound source is located in that subspace (or in a direction from the user within that subspace). Based thereon, the subspace of the first configuration (of FIG. 2C) that fulfills the predefined criterion (subspace for which $sssig_i$, i=1, 2, 3, 4 has MAX(S/N)) is selected and further subdivided into a second configuration of subspaces aiming at possibly finding a subspace, for which the corresponding spatial sound signal has an even larger signal to noise ratio (e.g. found by applying the same criterion that was applied to the first configuration of subspaces). Thereby, the subspace defined by $beam_{42}$ is identified as the subspace having the largest signal to noise ratio. An approximate direction to the source is automatically defined (within the spatial angle defined by subspace $beam_{42}$). If necessary a third subspace configuration based on $beam_{42}$ (or alternatively or additionally a finer subdivision of the subspaces of configuration 2 (e.g. more than two subspaces)) can be defined and the criterion for selection applied.

In the above example, the predefined criterion for selecting a subspace or the corresponding spatial sound signal was maximum signal to noise ratio. Other criteria may be defined, e.g. minimum signal to noise ratio or a predefined signal to noise ratio (e.g. in a predefined range). Other criteria may e.g. be based on maximum probability for voice detection, or minimum noise level, or maximum noise level, etc.

Figure 2E:
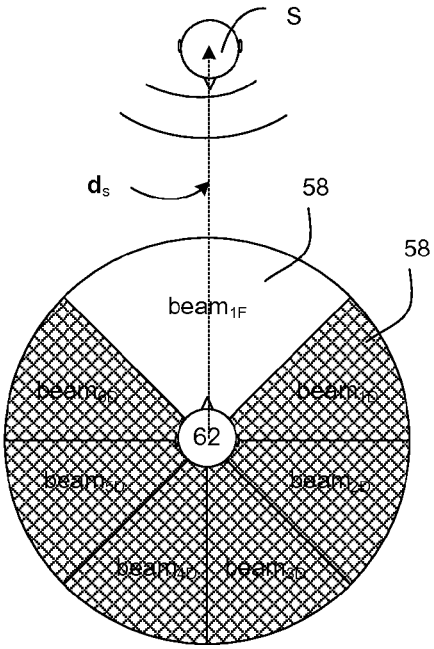

FIG. 2E illustrates a situation where the configuration of subspaces comprises fixed as well as adaptively determined subspaces. In the example shown in FIG. 2E a fixed subspace ($beam_{1F}$) is located in a direction $d_s$ towards a known target sound source S (e.g. a person or a loudspeaker) in front of the user 62, and wherein the rest of the subspaces (cross-hatched subspaces $beam_{1D}$ to $beam_{6D}$) are adaptively determined, e.g. determined according to the current acoustic environment. Other configurations of subspaces comprising a mixture of fixed and dynamically (e.g. adaptively) determined subspaces are possible.

Figure 3:
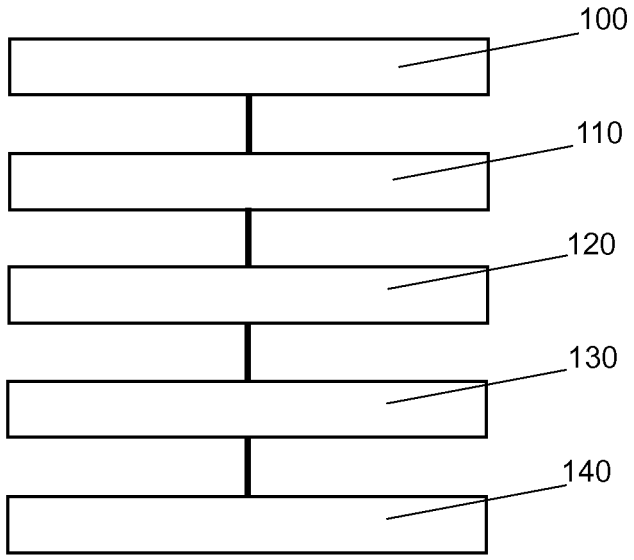
FIG. 3 shows a block diagram of an embodiment of a method for processing sound signals representing sound of an environment.

FIG. 3 shows an embodiment of a method for processing sound signals 22 and 24 representing incoming sound 20 of an environment. The method comprises the following steps.

100 Receiving sound signals 22 and 24 representing sound 20 of an environment.

110 Using the sound signals 22 and 24 to generate spatial sound signals 56. Each spatial sound signal 56 represents sound 20 coming from a subspace 58 of a total space 60.

120 Detecting whether a voice signal is present in a respective spatial sound signal 56 for all spatial sound signals 56. The step 120 is preferably performed in parallel for all spatial sound signals 56.

130 Selecting spatial sound signals 56 with a voice signal above a predetermined signal-to-noise ratio threshold. The step 130 is performed in parallel for all spatial sound signals 56.

140 Generating an output sound signal 28 from the selected spatial sound signals 56.

Alternatively, the step 110 can be dividing the sound signals in subspaces 58 generating spatial sound signals 56. A further alternative for step 110 is generating a total space sound signal from the sound signals 56 and dividing the total space sound signal in subspaces 58 of the total space 60 generating spatial sound signals 56.

The step 120 of detecting whether a voice signal is present in a respective spatial sound signal 56 can also be performed one after another for each of the spatial sound signals 56.

The step 130 of selecting spatial sound signals with a voice signal above a predetermined signal-to-noise ratio threshold can also be performed one after another for each of the spatial sound signals 56. The spatial sound signals 56 can also be selected based on a sound level threshold or a combination of a sound level threshold and a signal-to-noise ratio threshold. Further in an alternative embodiment spatial sound signals 56 can be selected, which do not comprise a voice signal.

REFERENCE SIGNS

10 hearing system
12 first microphone
14 second microphone
16 electric circuitry
18 speaker
20 incoming sound from the environment
22 first sound signal
24 second sound signal
26 line
28 output sound signal
30 output sound
32 spectral filterbank
33 sound signal combination unit
34 spatial filterbank
36 beamformer
38 voice activity detection unit
40 sound parameter determination unit
42 noise detection unit
44 control unit
46 spatial sound signal selection unit
48 noise reduction unit
50 user control interface
52 sound source localization unit
54 memory
55 output sound processing unit
56 spatial sound signals
57 transceiver unit
58 subspace
60 total space
62 user

The invention claimed is:

1. A hearing system configured to be worn by a user, the hearing system comprising:

an environment sound input unit;

an output transducer; and electric circuitry, wherein the environment sound input unit is configured to receive sound from the environment of the environment sound input unit and to generate sound signals representing sound of the environment, wherein the output transducer is configured to stimulate hearing of the user, wherein the electric circuitry comprises a spatial filterbank configured to use the sound signals to generate spatial sound signals dividing a total space of the environment sound in a plurality of subspaces, defining a configuration of the subspaces, wherein a spatial sound signal represents sound coming from a subspace, and wherein the hearing system is configured to provide a configuration of the subspaces wherein at least one subspace is fixed and wherein at least one subspace is adaptively determined.

2. A hearing system according to claim 1, wherein the spatial filterbank comprises at least one beamformer configured to process the sound signals by generating a spatial sound signal which represents sound coming from a subspace.

3. A hearing system according to claim 1, wherein the subspaces are cylinder sectors or cones of a sphere.

4. A hearing system according to claim 1, wherein the subspaces add up to the total space.

5. A hearing system according to claim 1, wherein the subspaces of the plurality of subspaces are equally spaced.

6. A hearing system according to claim 1, wherein the electric circuitry comprises a spatial sound signal selection unit configured to select one or more spatial sound signals and generate an output sound signal from the selected one or more spatial sound signals, and wherein the output transducer is configured to stimulate hearing of a user in dependence of the output sound signal.

7. A hearing system according to claim 6, wherein the spatial sound signal selection unit is configured to weight the selected one or more spatial sound signals and generate an output sound signal from the selected and weighted one or more spatial sound signals.

8. A hearing system according to claim 1, wherein the electric circuitry comprises a noise reduction unit configured to reduce noise in one or more spatial sound signals.

9. A hearing system according to claim 1, wherein the electric circuitry comprises at least one spectral filterbank configured to divide the sound signals in frequency bands.

10. A hearing system according to claim 1 comprising a hearing aid configured to stimulate the hearing of a hearing impaired user.

11. A hearing system configured to be worn by a user, the hearing system comprising:

an environment sound input unit;

an output transducer; and electric circuitry, wherein the environment sound input unit is configured to receive sound from the environment of the environment sound input unit and to generate sound signals representing sound of the environment, wherein the output transducer is configured to stimulate hearing of the user, wherein the electric circuitry comprises a spatial filterbank configured to use the sound signals to generate spatial sound signals dividing a total space of the environment sound in a plurality of subspaces, defining a configuration of the subspaces, wherein a spatial sound signal represents sound coming from a subspace, and wherein the electric circuitry further comprises a control unit configured to dynamically adjust the configuration of the subspaces.

12. A hearing system according to claim 11, wherein the electric circuitry comprises a voice activity detection unit configured to determine whether a voice signal is present in a respective spatial sound signal, and/or a noise detection unit configured to determine whether a noise signal is present in, or to determine a level of noise of, a respective spatial sound signal.

13. A hearing system according to claim 11 configured to provide a configuration of the subspaces wherein at least one subspace is fixed and wherein at least one subspace is adaptively determined.

14. A hearing system configured to be worn by a user, the hearing system comprising:

an environment sound input unit;

an output transducer; and electric circuitry, wherein the environment sound input unit is configured to receive sound from the environment of the environment sound input unit and to generate sound signals representing sound of the environment, wherein the output transducer is configured to stimulate hearing of the user, wherein the electric circuitry comprises a spatial filterbank configured to use the sound signals to generate spatial sound signals dividing a total space of the environment sound in a plurality of subspaces, defining a configuration of the subspaces, wherein a spatial sound signal represents sound coming from a subspace, wherein the electric circuitry further comprises a voice activity detection unit configured to determine whether a voice signal is present in a respective spatial sound signal, and/or a noise detection unit configured to determine whether a noise signal is present in, or to determine a level of noise of, a respective spatial sound signal, and wherein the electric circuitry further comprises a control unit configured to adaptively adjust the configuration of the subspaces according to the output of the voice activity detection unit and/or the noise detection unit.

15. A hearing system configured to be worn by a user, the hearing system comprising:

an environment sound input unit;

an output transducer; and electric circuitry, wherein the environment sound input unit is configured to receive sound from the environment of the environment sound input unit and to generate sound signals representing sound of the environment, wherein the output transducer is configured to stimulate hearing of the user, wherein the electric circuitry comprises a spatial filterbank configured to use the sound signals to generate spatial sound signals dividing a total space of the environment sound in a plurality of subspaces, defining a configuration of the subspaces, wherein a spatial sound signal represents sound coming from a subspace, and wherein the electric circuitry further comprises a user control interface configured to allow a user to adjust the configuration of the subspaces.

16. A hearing system configured to be worn by a user, the hearing system comprising:

an environment sound input unit;

an output transducer; and electric circuitry, wherein the environment sound input unit is configured to receive sound from the environment of the environment sound input unit and to generate sound signals representing sound of the environment, wherein the output transducer is configured to stimulate hearing of the user, wherein the electric circuitry comprises a spatial filterbank configured to use the sound signals to generate spatial sound signals dividing a total space of the environment sound in a plurality of subspaces, defining a configuration of the subspaces, wherein a spatial sound signal represents sound coming from a subspace, and wherein the hearing system is configured to analyse the sound signals representing sound of the environment in at least a first and a second step using first and second different configurations of subspaces by the spatial filterbank in the first and second steps, respectively, and where the second configuration is derived from an analysis of spatial sound signals of the first configuration of the subspaces.

17. A method for processing sound signals representing sound of an environment with a hearing system, comprising:

receiving sound signals representing sound of an environment with an environment sound input unit of the hearing system;

using the sound signals with a spatial filterbank of the hearing system to generate spatial sound signals dividing a total space of the environment sound in a plurality of subspaces, wherein each spatial sound signal represents sound coming from a subspace of a total space;

defining a configuration of the subspaces;

detecting with a voice activity detection unit whether a voice signal is present in a respective spatial sound signal for all spatial sound signals;

adaptively adjusting the configuration of the subspaces according to the output of the voice activity detection unit and/or a noise detection unit;

selecting spatial sound signals with a voice signal above a predetermined signal-to-noise ratio threshold; and generating an output sound signal from the selected spatial sound signals.

* * * * *